US012239268B2

(12) United States Patent
Kappos et al.

(10) Patent No.: US 12,239,268 B2
(45) Date of Patent: Mar. 4, 2025

(54) SYSTEM, METHOD AND DEVICE FOR CLEANING USING A SUB-SURFACE FLUID INJECTOR

(71) Applicants: Paul D. Kappos, Bountiful, UT (US); Brent D. Kappos, Salt Lake City, UT (US)

(72) Inventors: Paul D. Kappos, Bountiful, UT (US); Brent D. Kappos, Salt Lake City, UT (US)

( * ) Notice: Subject to any disclaimer, the term of this patent is extended or adjusted under 35 U.S.C. 154(b) by 0 days.

(21) Appl. No.: 17/410,848

(22) Filed: Aug. 24, 2021

(65) Prior Publication Data

US 2022/0079407 A1 Mar. 17, 2022

Related U.S. Application Data

(60) Provisional application No. 63/069,527, filed on Aug. 24, 2020.

(51) Int. Cl.
*A47L 11/34* (2006.01)
*A47L 11/40* (2006.01)

(52) U.S. Cl.
CPC ..... *A47L 11/34* (2013.01); *A47L 11/4016* (2013.01); *A47L 11/4088* (2013.01); *A47L 11/4094* (2013.01)

(58) Field of Classification Search
CPC ..... A47L 11/34; A47L 7/0009; A47L 9/02; A47L 11/36; A47L 11/4088; A47L 23/263; B05B 15/55; B05B 11/00; B05B 11/042; B08B 3/12; B08B 3/00
USPC ..... 15/320, 301, 310, 393
See application file for complete search history.

(56) References Cited

U.S. PATENT DOCUMENTS

| | | | | |
|---|---|---|---|---|
| 4,069,541 A * | 1/1978 | Williams | A47L 11/4044 | 15/382 |
| 4,109,340 A * | 8/1978 | Bates | A47L 11/34 | 165/51 |
| 4,841,999 A * | 6/1989 | Danko | B08B 15/026 | 134/22.12 |
| 9,901,656 B2 * | 2/2018 | Behr | B05B 11/04 | |
| 2006/0076064 A1 * | 4/2006 | Carter | F16K 15/044 | 137/601.19 |
| 2022/0233045 A1 * | 7/2022 | Karren | A47L 11/34 | |

* cited by examiner

*Primary Examiner* — Brian D Keller
*Assistant Examiner* — Sidney D Full
(74) *Attorney, Agent, or Firm* — TechLaw Ventures, PLLC; Terrence J. Edwards

(57) ABSTRACT

Systems, methods, and devices for cleaning a surface and sub-surface or flooring, such as a carpeted flooring and/or fabrics including carpet backing, padding, upholstery, mattress, etc., using a sub-surface fluid injector, such as a pulsation fluid injector are disclosed. The systems, methods, and devices enable spot cleaning a surface or flooring, such as a carpet and cleaning underneath the carpet surface, thereby eliminating reoccurring spots from spills and embedded odors, such as pet urine, using a sub-surface pulsation fluid injector to flush-clean through the sub-surfaces of the flooring thoroughly. The device of the disclosure safely provides a continuous free-flowing stream of fluid through all areas above and below the surface or flooring, for example the carpet face fibers, carpet backing and padding or underlay, in order to chemically treat, break down, carry out and/or remove certain contaminants embedded in the carpeted flooring.

15 Claims, 10 Drawing Sheets

SYSTEM, METHOD AND DEVICE FOR CLEANING USING A SUB-SURFACE FLUID INJECTOR

CROSS-REFERENCE TO RELATED APPLICATIONS

This application claims the benefit of U.S. Provisional Application No. 63/069,527, filed Aug. 24, 2020, which is incorporated herein by reference in its entirety, including but not limited to those portions that specifically appear hereinafter, the incorporation by reference being made with the following exception: In the event that any portion of the above-referenced provisional application is inconsistent with this application, this application supersedes said above-referenced provisional application.

TECHNICAL FIELD

The disclosure relates generally to systems, methods, and devices for cleaning flooring using a sub-surface pulsation fluid injector; and more particularly relates to systems, methods, and devices for spot cleaning flooring, such as carpets, and cleaning underneath the carpet surface, thereby eliminating reoccurring spots from spills and embedded odors, such as pet urine, using a sub-surface pulsation fluid injector to flush-clean through the sub-surface areas of the flooring thoroughly.

BACKGROUND

A variety of carpet cleaning devices, including cleaning fluid applicators and vacuum apparatuses with nozzles or suction heads for removing cleaning fluids from surfaces, are well-known in the art. For example, cleaning fluids or carpet shampoos are applied to a surface of a carpet. A wet-vacuum cleaner and nozzle, having one or a plurality of slots in a bottom plate that open through the plate into a relatively shallow vacuum manifold or nozzle chamber leading directly to the vacuum hose, may be used to apply suction the carpet surface. Such a nozzle is intended for vacuuming fluids from saturated carpeted flooring that have had cleaning fluids or other fluids applied thereto.

However, such carpet cleaning devices and nozzles known in the art only provide for liquid extraction from a surface of the carpet and not for cleaning through the sub-surface, middle, and surface of the carpet and/or fabrics including upholstery, padding, garments, mattress, and wall coverings, etc. Such carpet cleaning devices, nozzles, and techniques are not able to inject a cleaning fluid using a fluid injector to flush-clean through the sub-surfaces, middles, and surfaces of the flooring thoroughly. Thus, it would be an improvement in the art to provide a sub-surface fluid injector that applies cleaning solutions to a sub-surface beneath carpeting to flush-clean through the sub-surfaces, middles, and upper surfaces of the flooring thoroughly as a device or part of a system or method as Applicant herein discloses.

SUMMARY

Systems, methods, and devices are herein disclosed for cleaning a surface or flooring, such as a carpet and/or fabrics including carpet backing and padding, upholstery, and mattress etc., using a sub-surface fluid injector, for example a pulsation fluid injector. This disclosure particularly relates to systems, methods, and devices for spot cleaning a surface or flooring, such as carpets, and cleaning underneath the carpet surface and through the carpet core, thereby eliminating reoccurring spots from spills and embedded odors and embedded contaminants, such as pet urine, using a sub-surface fluid injector to flush-clean through the sub-surfaces, cores, and upper surfaces of the carpet or flooring thoroughly. It is an objective of the disclosure to safely provide a continuous free-flowing stream of water, cleaning fluid, other liquids, and/or cleaning substances through all areas above and below the surface or flooring, for example the carpet face fibers, carpet backing and padding or underlay, in order to chemically treat, break down, carry out and/or remove certain contaminants, stains, and odors embedded in the carpet, surface, or flooring.

In an embodiment of the disclosure it is an object to provide a system for removing or eliminating reoccurring spots from spills and embedded odors, such as pet urine, using a sub-surface fluid injector to flush-clean through the sub-surfaces, cores, and upper surfaces of flooring, such as a carpet and/or fabrics including carpet backing and padding, upholstery, and mattress etc., thoroughly that includes a vacuum or extraction apparatus and a pointed tube that is bent into a curve or a substantial 90 angle or dogleg or a tube that possesses a certain degree of flexibility to thereby facilitate the tube's ability to: 1) penetrate a porous membrane, such as a carpeted or other flooring membrane, in order to discharge a fluid into the sub-surface area of the membrane, or the pad and carpet backing under the face fibers of carpeted or other surface or flooring; and 2) to discharge the fluid in a controlled manner over a broad area from the point of original penetration, notwithstanding the inability of the tube to penetrate the membrane or carpet in an area blocked from the surface by an extraction apparatus or other obstacles. The several configurations and embodiments described herein allow a source of a vacuum or an extraction apparatus to simultaneously draw and remove the fluid through a porous membrane, such as carpeted flooring, as the fluid is being discharged in the sub-surface area by a fluid injector positioned directly under the extraction apparatus positioned on the surface of the carpet or porous membrane.

In an embodiment of the disclosure it is an object to provide a device for removing or eliminating reoccurring spots from spills and embedded odors, such as pet urine, using a sub-surface fluid injector to flush-clean through the sub-surfaces, cores, and upper surfaces of flooring, such as a carpet and/or fabrics including carpet backing and padding, upholstery and mattress etc., thoroughly that includes a pointed tube that is bent into a curve or a substantial 90 angle or dogleg or a tube that possesses a certain degree of flexibility to thereby facilitate the tube's ability to: 1) penetrate a porous membrane, such as carpeted or other surface or flooring, in order to discharge a fluid into the sub-surface area of the membrane, or the pad and carpet backing under the face fibers of carpeted or other surface or flooring; and 2) to discharge the fluid in a controlled manner over a broad area from the point of original penetration, notwithstanding the inability of the tube to penetrate the membrane or carpet in an area blocked from the surface by an extraction apparatus or other obstacles.

In an embodiment of the disclosure, it is an object to provide a method for removing or eliminating reoccurring spots from spills and embedded odors, such as pet urine, using a sub-surface fluid injector to flush-clean through the sub-surfaces, cores, and upper surfaces of flooring, such as a carpet and/or fabrics including carpet backing and padding, upholstery, and mattress etc., thoroughly. The method may utilize a vacuum or extraction apparatus and a pointed tube that is bent into a curve or a substantial 90 angle or dogleg or a tube that possesses a certain degree of flexibility to thereby facilitate the tube's ability to: 1) penetrate a porous membrane, such as carpeted or other surface or flooring, in order to discharge a fluid into the sub-surface area of the membrane, or the pad and carpet backing under the face fibers of carpeted or other surface or flooring; and 2) to discharge the fluid in a controlled manner over a broad area from the point of original penetration, notwithstanding the inability of the tube to penetrate the membrane or carpet in an area blocked from the surface by an extraction apparatus or other obstacles. The several configurations and embodiments described herein allow a source of a vacuum or an extraction apparatus to simultaneously draw and remove the fluid through a porous membrane, such as carpeted flooring, as the fluid is being discharged in the sub-surface area directly by a fluid injector positioned under the extraction apparatus as it is positioned on the surface of the carpet or porous membrane.

In an embodiment of the system, device, and method of the disclosure it is an object to provide a flexible tip that may be affixed to the end of the tube in order to smoothly penetrate a membrane without scratching or marring a substrate that the membrane is supported by, such as wood sub-flooring under carpeted flooring, or a surface, such as a carpet and/or fabrics including carpet backing and padding, upholstery, and mattress, etc.

In an embodiment of the system, device, and method of the disclosure it is an object to provide towards the end of the tube and close to the flexible tip one or more round or elongated holes for side discharge of fluid to better disperse the fluid in a controlled manner through the porous membrane prior to extraction of the fluid from the surface with a secondary apparatus generating vacuum pressure.

In an embodiment of the system, device, and method of the disclosure it is an object to provide the fluid such that it may be discharged from the tube in a pulsating manner for enhanced physical agitation of the membrane and the elements or contaminants targeted by the process for treatment or removal from the porous membrane or carpeted flooring.

In an embodiment of the system, device, and method of the disclosure it is an object to provide the fluid such that it may be discharged from the tube under pressure for enhanced physical agitation of the membrane and the elements or contaminants targeted by the process for treatment or removal from the porous membrane or carpeted flooring.

In an embodiment of the system, device, and method of the disclosure it is an object to provide a nozzle or suction head and a sub-surface fluid injector finding particular, but not necessarily exclusive, utility for vacuum removal of water or other liquids or cleaning substances from a sub-surface, core, and/or upper surface of flooring such as a carpet and/or fabrics including carpet backing and padding, upholstery, and mattress, etc.

In an embodiment of the system, device, and method of the disclosure it is an object to provide a nozzle or suction head of the foregoing character, which efficiently and rapidly removes standing water, stain removal solutions and other liquids and cleaning substances from fabric or carpeting installed on a floor, including sub-surfaces, cores, and upper surfaces thereof.

In an embodiment of the system, device, and method of the disclosure it is an object to provide a nozzle or suction head of the foregoing character which increases the flow of fluid therethrough upon the application of suction to facilitate rapid and thorough removal of fluid and thereby prevent moisture damage to a carpet, its pad and/or floor.

BRIEF DESCRIPTION OF THE DRAWINGS

Non-limiting and non-exhaustive implementations of the present disclosure are described with reference to the following figures, wherein like reference numerals refer to like parts throughout the various views unless otherwise specified. Advantages of the present disclosure will become better understood with regard to the following description and accompanying drawings where.

DETAILED DESCRIPTION

Figure 1:
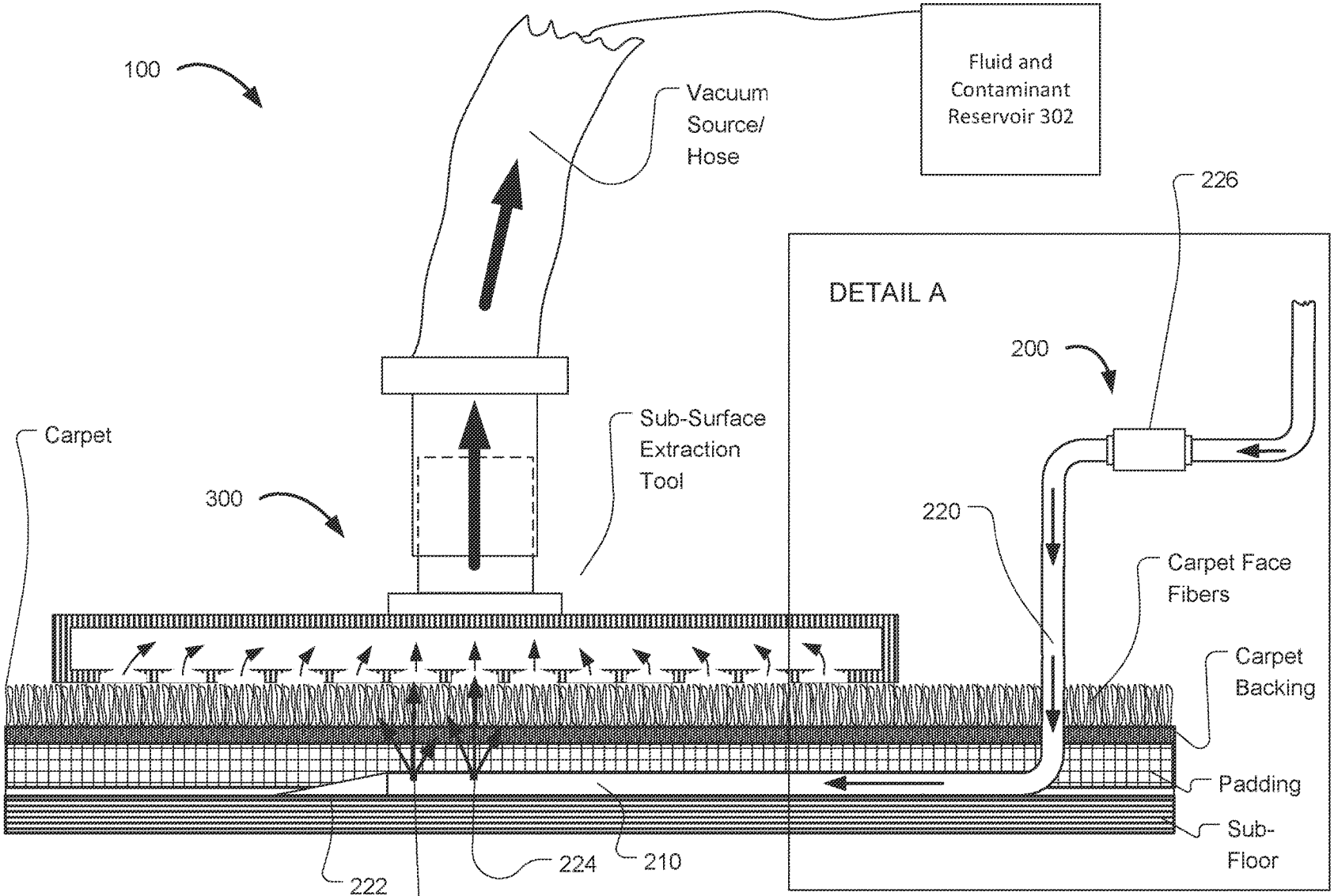
FIG. 1 illustrates a system for removing or eliminating reoccurring spots from spills and removing contaminants and embedded odors, such as pet urine, using a sub-surface fluid injector to flush-clean through the sub-surfaces, cores, and upper surfaces of a surface or flooring, such as a carpet and/or fabrics including carpet backing and padding, upholstery, and mattress, etc., according to at least one embodiment of the disclosure.

The present disclosure extends to systems, methods and devices for cleaning a surface or flooring, such as a carpet and/or fabrics including carpet backing and padding, upholstery and mattress, etc., using a sub-surface fluid injector, such as a pulsation fluid injector; and more particularly extends to systems, methods, and devices for spot cleaning a surface or flooring, such as a carpet and/or fabrics including carpet backing and padding, upholstery and mattress, etc., and cleaning underneath the carpet surface and throughout the carpet, thereby eliminating reoccurring spots from spills and removing contaminants and embedded odors, such as pet urine, using a sub-surface pulsation fluid injector to flush-clean through the sub-surfaces, cores, and upper surfaces of the flooring thoroughly. The disclosure safely provides a continuous free-flowing stream of water, cleaning fluids, liquids, and/or other cleaning substances through all areas above, below, and through the flooring, for example the carpet face fibers, carpet backing and padding or underlay, in order to chemically treat, break down, carry out and/or remove certain contaminants embedded in the flooring.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the structure, systems, devices, and methods for cleaning of flooring are disclosed and described, it is to be understood that this disclosure is not limited to the particular structures, configurations, process steps, and materials disclosed herein as such structures, configurations, process steps, and materials may vary somewhat. It is also to be understood that the terminology employed herein is used for the purpose of describing particular embodiments only and is not intended to be limiting since the scope of the disclosure will be limited only by the appended claims and equivalents thereof.

In describing and claiming the subject matter of the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

As used herein, the phrase "consisting of" and grammatical equivalents thereof exclude any element or step not specified in the claim.

As used herein, the phrase "consisting essentially of" and grammatical equivalents thereof limit the scope of a claim to the specified materials or steps and those that do not materially affect the basic and novel characteristic or characteristics of the claimed disclosure.

A detailed description of systems and methods consistent with embodiments of the present disclosure is provided below. While several embodiments are described, it should be understood that this disclosure is not limited to any one embodiment, but instead encompasses numerous alternatives, modifications, and equivalents. In addition, while numerous specific details are set forth in the following description in order to provide a thorough understanding of the embodiments disclosed herein, some embodiments may be practiced without some or all of these details. Moreover, for the purpose of clarity, certain technical material that is known in the related art has not been described in detail in order to avoid unnecessarily obscuring the disclosure.

Figure 2:
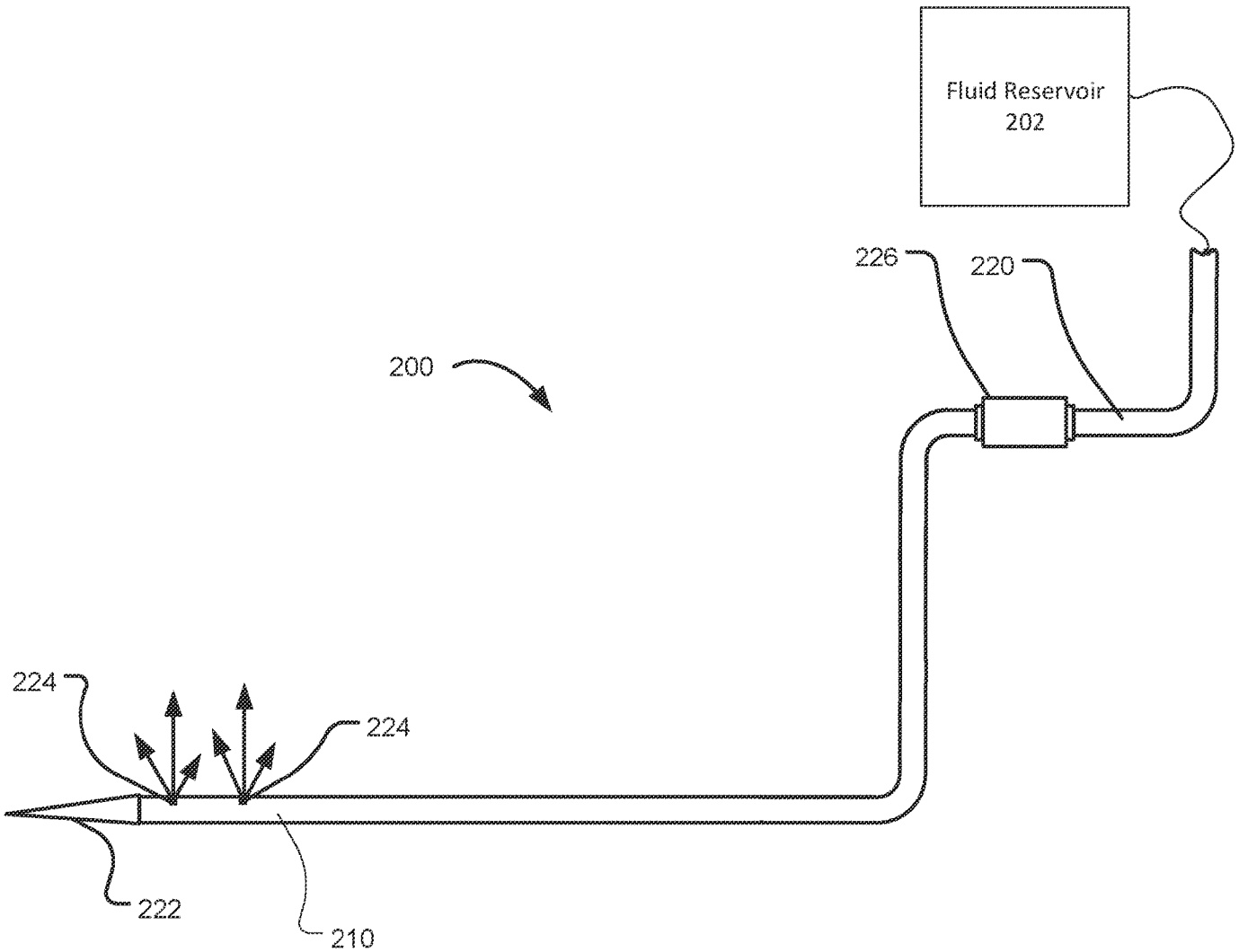
FIG. 2 illustrates a device for removing or eliminating reoccurring spots from spills and removing contaminants and embedded odors, such as pet urine, using a sub-surface fluid injector to flush-clean through the sub-surfaces, cores, and upper surfaces of a surface or flooring, such as a carpet and/or fabrics including carpet backing and padding, upholstery, and mattress, etc., according to at least one embodiment of the disclosure.
Figure 3:
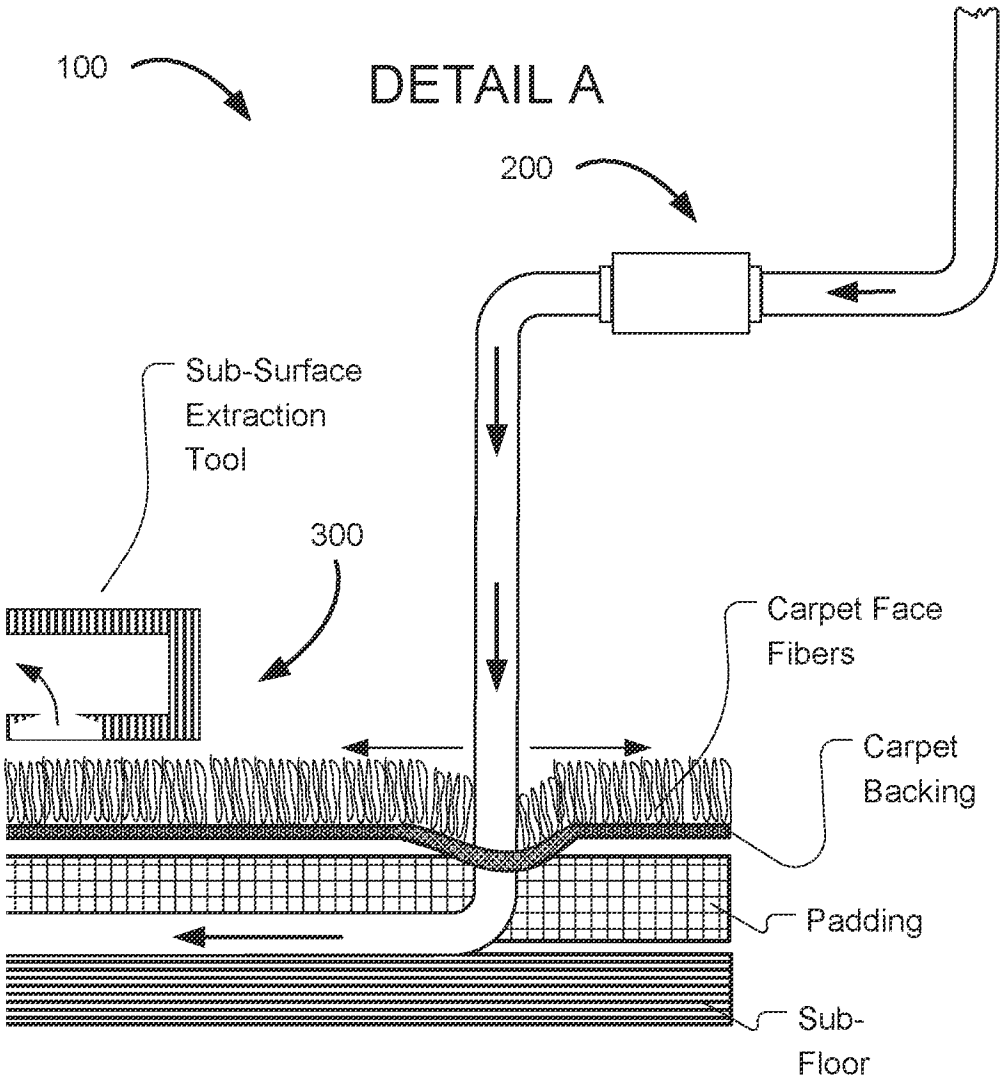
FIG. 3 is an enlarged view of Detail A of FIG. 1 illustrating the device separating fibers and fabric of the surface or flooring, such as a carpet and/or fabrics including carpet backing and padding, upholstery, and mattress, etc., to allow entry of the device into the sub-surface area according to at least one embodiment of the disclosure.

FIGS. 1-3 illustrate a cleaning system 100 and a cleaning device 200 for removing or eliminating reoccurring spots from spills and embedded odors, such as pet urine, from a surface or flooring, such as a carpet and/or fabrics including carpet backing and padding, upholstery, and mattress, etc. FIG. 1 illustrates a configuration of cleaning device 200 disposed in between layers of flooring being cleaned. FIG. 2 illustrates a plan view of cleaning device 200 where cleaning device 200 is not inserted into flooring.

The system 100 may include the cleaning device 200 and a vacuum or extraction apparatus 300. The cleaning device 200 provides a mechanism for safely providing a continuous free-flowing stream of water, cleaning fluids, liquids, and/or other cleaning substances through all surfaces and areas both above and below the flooring, for example the carpet face fibers, carpet backing and padding or underlay, in order to chemically treat, break down, carry out and/or remove certain contaminants embedded in the flooring.

The cleaning device 200 and the vacuum or extraction apparatus 300 work together to provide fluid (e.g., water, cleaning fluid, soap, carpet shampoo, deodorizer, stain remover, and/or other cleaning fluids and substances) that may be pressurized and/or pulsated into the sub-floor area and then vacuumed or otherwise extracted using the extraction apparatus 300. Thus, the vacuum or extraction apparatus 300 is allowed to simultaneously draw and remove the fluid through a porous membrane, such as carpeted flooring, as the fluid is being discharged in the sub-surface area (e.g., between sub-floor and carpet padding, between carpet padding and surface carpet, and/or between the surface carpet and any layers beneath the surface carpet) directly under the extraction apparatus 300 positioned on the surface of the carpet or porous membrane as illustrated in FIG. 1.

The cleaning device 200 may include a sub-surface fluid injector 210 to flush-clean through the sub-surfaces of the flooring. The cleaning device 200 may include a tube 220 that has a pointed end 222 to allow insertion of the cleaning device 200 beneath the surface of the carpet or other fabric or flooring material. The tube 220 may be substantially straight, or may be bent into one or more curves, arcs, or bends, or may include a dogleg or the tube may possess a certain degree of flexibility to thereby facilitate the tube's ability to: 1) penetrate a porous membrane, such as a carpeted or other flooring membrane, in order to discharge a fluid into the sub-surface area of the membrane, or the pad and carpet backing under the face fibers of carpeted or other surface or flooring; and 2) to discharge the fluid in a controlled manner over a broad area from the point of original penetration, notwithstanding the inability for the tube to penetrate the membrane or carpet in an area blocked from the surface by an extraction apparatus or other obstacles.

The shapes and configurations of the curves and bends of the tube are not necessarily limited by the disclosure, as shown in the figures, the bends of the tube 220 may be substantially 90 degree bends to facilitate inserting sub-surface fluid injector 210. For example, as shown in at least FIG. 1, a lower portion of sub-surface fluid injector 210 may be disposed under the carpet/padding, and a bend in tube 220 may turn tube 220 to extend above the flooring to allow sub-surface fluid injector 210 to lay flat under flooring while a user has access to actuate a flow valve above the flooring. In alternative embodiments, the curves and bends of tube 220 may be any angle, not just 90 degrees. For example, the bend may preferably be anywhere between 0 degrees and 90 degrees. However, any angle may be workable for the device. The bend may make it more convenient for a user to maneuver a first portion of sub-surface fluid injector 210 to be beneath flooring substantially parallel to the flooring, while allowing a second portion of the sub-surface fluid injector to be above the flooring to provide the user access to start the flow of cleaning fluid. However, as long as the sub-surface fluid injector is able to be maneuvered in place beneath the flooring to be cleaned, any angle or lack of angle may be acceptable.

Accordingly, the cleaning device 200 may be used for removing or eliminating reoccurring spots from spills and embedded odors, such as pet urine, using a sub-surface fluid injector to flush-clean through the sub-surfaces of the surface or flooring, such as a carpet and/or fabrics including upholstery, padding, garments, mattress, and wall coverings, etc., thoroughly. The sub-surface fluid injector of cleaning device 200 may include a pointed tube that is straight, bent into a curve, or a substantial 90 degree angle or dogleg. The tube may also possess a certain degree of flexibility to thereby facilitate the tube's ability to: 1) penetrate a porous membrane, such as carpeted or other surface or flooring, in order to discharge a fluid into the sub-surface area of the membrane, or the pad and carpet backing under the face fibers of carpeted or other surface or flooring; and 2) to discharge the fluid in a controlled manner over a broad area from the point of original penetration, notwithstanding the inability for the tube to penetrate the membrane or carpet in an area blocked from the surface by an extraction apparatus or other obstacles.

As shown in FIGS. 1 and 2, the system 100 and cleaning device 200 of the disclosure may include a pointed end 222 that may be affixed to the end of the tube 220 in order to penetrate a membrane such as carpeting, fabrics including carpet backing and padding, upholstery, and mattress, etc. Pointed end 222 may be rigid to more reliably penetrate through the membrane and any layers disposed beneath said membrane. Alternatively, in order to smoothly penetrate a membrane without scratching or marring a substrate that the membrane is supported by, such as wood sub-flooring under carpeted flooring, or a surface, such as a carpet and/or fabrics including carpet backing and padding, upholstery, and mattress, etc., the pointed end 222 may be flexible. In fact, any portion of cleaning device 200, including pointed end 222, sub-surface fluid injector 210, or any part of tube 220 may be either flexible or rigid, depending on the desires of the user. Further, towards the end of the tube 220 and close to the pointed end 222 one or more round or elongated holes 224 for side discharge of fluid to better disperse the fluid in a controlled manner through the porous membrane prior to or simultaneous with extraction of the fluid from the surface with a secondary apparatus generating vacuum pressure, such as extraction apparatus 300.

Cleaning of a floor including carpeting with the cleaning device 200 may be done as follows. Cleaning device 200 may penetrate flooring through puncturing the carpet (shown in FIG. 3) and be navigated into place underneath carpeting that is contaminated with spills, stains, dirt, and/or odors. Alternatively, cleaning device 200 may be placed under carpeting or padding without puncturing the carpeting/padding by lifting up the carpet and padding at an edge and placing cleaning device thereunder. FIG. 1 shows an exemplary configuration where the sub-surface fluid injector 210 is guided into place between a sub-floor and carpet padding. While this configuration is one example, the disclosure is not limited to this location for the sub-surface fluid injector 210. Sub-surface fluid injector 210 may be placed, for example, between the sub-floor and the padding, between the padding and the carpet, resting on an upper surface of the carpet between carpet threads, or may also be penetrated within the core of said elements such as the padding and carpet. In other words, sub-surface fluid injector 210 may be placed in between any of a plurality of layers of flooring materials.

Once sub-surface fluid injector 210 is maneuvered into place in a desired layer of flooring, extraction apparatus 300 may be placed over the carpet at a position corresponding to the position of sub-surface fluid injector 210 disposed underneath the carpet. For positioning of the extraction apparatus 300 over sub surface fluid injector 210, it may be preferable that the extraction apparatus 300 cover an area over all holes 224 formed in sub-surface fluid injector 210A. It may be even more preferable for the holes 224 to be under a center of extraction apparatus 300, or at least within a central region of extraction apparatus 300. The size of the central region is not particularly limited. The central region where holes 224 are preferably disposed under extraction apparatus 300 may make up about 10% to about 80% of an area of the extraction apparatus 300. Having holes 224 sufficiently in a central region of extraction apparatus 300, will prevent sprayed cleaning fluid from settling and flowing away from extraction apparatus 300, where the fluid may settle and cause damage and rot to the elements being cleaned.

Once holes are placed beneath extraction apparatus, a user may actuate a flow valve 226 on cleaning device 200 to turn on or off the flow of fluids through cleaning device 200. The flow valve 226 may be actuated by a switch, lever, knob, etc. Actuation of flow valve 226 may cause cleaning fluid from a reservoir 202 attached to and in fluid communication with cleaning device 200 to be sprayed out of holes 224 in an area between the sub-floor and the padding, for example. Extraction apparatus 300 may provide suction to the upper surface of carpet. The porous nature of carpet and padding may allow for air flow through the carpet and padding, thereby causing the released cleaning fluid to penetrate through the padding, the carpet backing, the carpet face fibers, and so forth as the cleaning fluid is extracted by extraction apparatus 300. The extracted cleaning fluid may then be moved by pressure difference through the extraction apparatus 300 and the vacuum source hose attached to the extraction apparatus 300 to a reservoir 302 for collecting extracted fluids. Contaminants, debris, stains, and odors are removed from the carpet and deposited in the reservoir 302 connected to extraction apparatus 300 along with the extracted cleaning fluid, leaving the carpet and padding clean throughout.

The pressurized spraying of cleaning fluids out of sub-surface fluid injector 210, in conjunction with pulling the fluids through all layers of flooring (e.g., padding, carpet backing, carpet face fibers, etc.) causes fluid to clean all layers of flooring, not just surface layers of carpeting. Accordingly, the present disclosure presents various embodiments that provide improvements over the current art of carpet cleaning.

It will be appreciated that disposing sub-surface fluid injector 210 between the sub-floor and padding will allow the cleaning fluid to be pulled through all layers of flooring by the extraction apparatus 300, thus cleaning all layers of flooring. However, if a user desires to give more focused cleaning to the carpet instead of the padding, sub-surface fluid injector 210 may be disposed between the carpet and the padding so that the direct flow of cleaning fluid is on the carpet. In other words, the sub-surface fluid injector 210 may be placed anywhere between or within any flooring layers depending on the desired layer(s) to be cleaned.

In an embodiment of the system 100 and cleaning device 200 of the disclosure, the fluid may be discharged from the tube of sub-surface fluid injector 210 in a pulsating manner for enhanced physical agitation of the membrane and the elements or contaminants targeted by the process for treatment or removal from the porous membrane. For example, the flow valve 226 may be a pulsating fluid valve that intermittently pulses pressurized fluid in a vibrating, oscillating, or repeating manner. Pulsating the cleaning fluid allows for greater physical agitation of the padding and carpet in order to more effectively break up, loosen, release, and dislodge contaminants, dirt, stains and odors from the carpet and padding. At certain pulsating frequencies, the fluid pulses may match a resonant frequency of the flooring, carpet, or padding, or of the dirt and contaminants being cleaned from the flooring. In such cases, the physical agitation of the flooring and contaminants may be even further increased and facilitate greater breaking up and removal of contaminants. Furthermore, certain frequencies of pulsation may generate harmonics that may also lead to greater physical agitation of materials being cleaned and contaminants. Thus, pulsating may lead to improved cleaning of carpeting, flooring, padding and other materials.

The pulsating of fluids in the sub-surface fluid injector 210 may be accomplished by any known means, such as a pulsating flow valve or a separate pulsating flow component 226 (shown in FIG. 4) used in conjunction with a constant flow valve 226 to ensure that fluid exiting holes 224 is pulsated to break up contaminants. Pulsating flow valve 226 and separate pulsating component 228 may each accomplish pulsating by mechanical means or by electrical means. For example, a mechanical means for pulsating fluid may include using kinetic energy of a fluid jet or flow to turn a small turbine attached to a rotating wheel that has holes in therein, so that regular bursts of fluid are released through nozzles to produce a pulsating effect. Pulsating may also be accomplished electrically by electronically rapidly opening and closing the flow valve to allow intermittent pulses of fluid to be emitted. Furthermore, oscillating driving of a fluid pump, alternating between different fluid pumps to create different power alternating pulses, etc., are other examples that may be used to pulsate fluid out of cleaning device 200. Any alternative methods for pulsating fluid known in the art may be used to pulsate the fluid out of sub-surface fluid injector 210 into flooring for cleaning.

In an embodiment of the system 100 and cleaning device 200 of the disclosure, the fluid may be discharged from the tube under pressure for enhanced physical agitation of the membrane and the elements or contaminants targeted by the process for treatment or removal from the porous membrane.

In an embodiment of the system 100 and cleaning device 200 of the disclosure, a nozzle or suction head and a sub-surface fluid injector 210 finding particular, but not necessarily exclusive, utility for vacuum removal of water or other cleaning liquids and substances from a surface such as a carpet and/or fabrics including carpet backing and padding, upholstery, and mattress, etc. is provided.

Thus, the system 100 and the cleaning device 200 safely provide a continuous or pulsating free-flowing steam of water or other cleaning/disinfecting/deodorizing fluids and substances through all areas above and below the surface of flooring, such as the carpet face fibers, carpet backing and padding or underlay, in order to chemically treat, break down and carry out certain contaminants embedded in the flooring.

Figure 5:
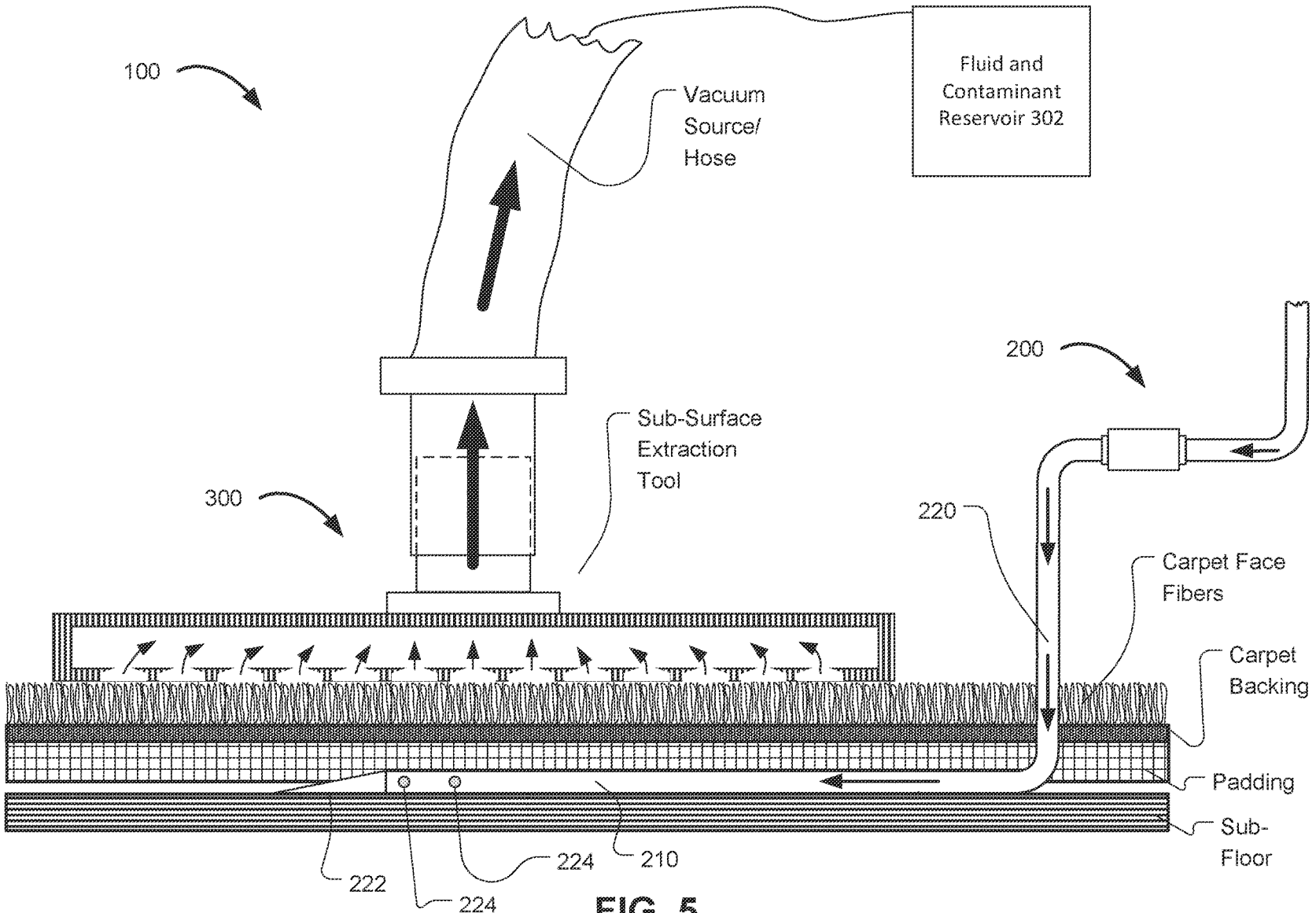
FIG. 5 illustrates a system for removing or eliminating reoccurring spots from spills and removing contaminants and embedded odors, such as pet urine, using a sub-surface fluid injector to flush-clean through the sub-surfaces, cores, and upper surfaces of a surface or flooring, such as a carpet and/or fabrics including carpet backing and padding, upholstery, and mattress, etc., according to at least one embodiment of the disclosure.

FIG. 5 illustrates an alternative embodiment of cleaning device 200 in system 100 wherein positioning of holes 224 is different than as shown in FIGS. 1 and 2. Holes 224 for dispensing cleaning fluid from sub-surface fluid injector 210 are shown substantially disposed in a top surface of sub-surface fluid injector 210 in FIGS. 1 and 2. However, the disclosure is not so limited. Holes 224 may have a plurality of shapes, sizes, orientations, and locations on sub-surface fluid injector 210 and still remain within the scope of the disclosure. Different configurations and placements of holes may lead to different advantageous cleaning effects for the system 100.

Figure 4:
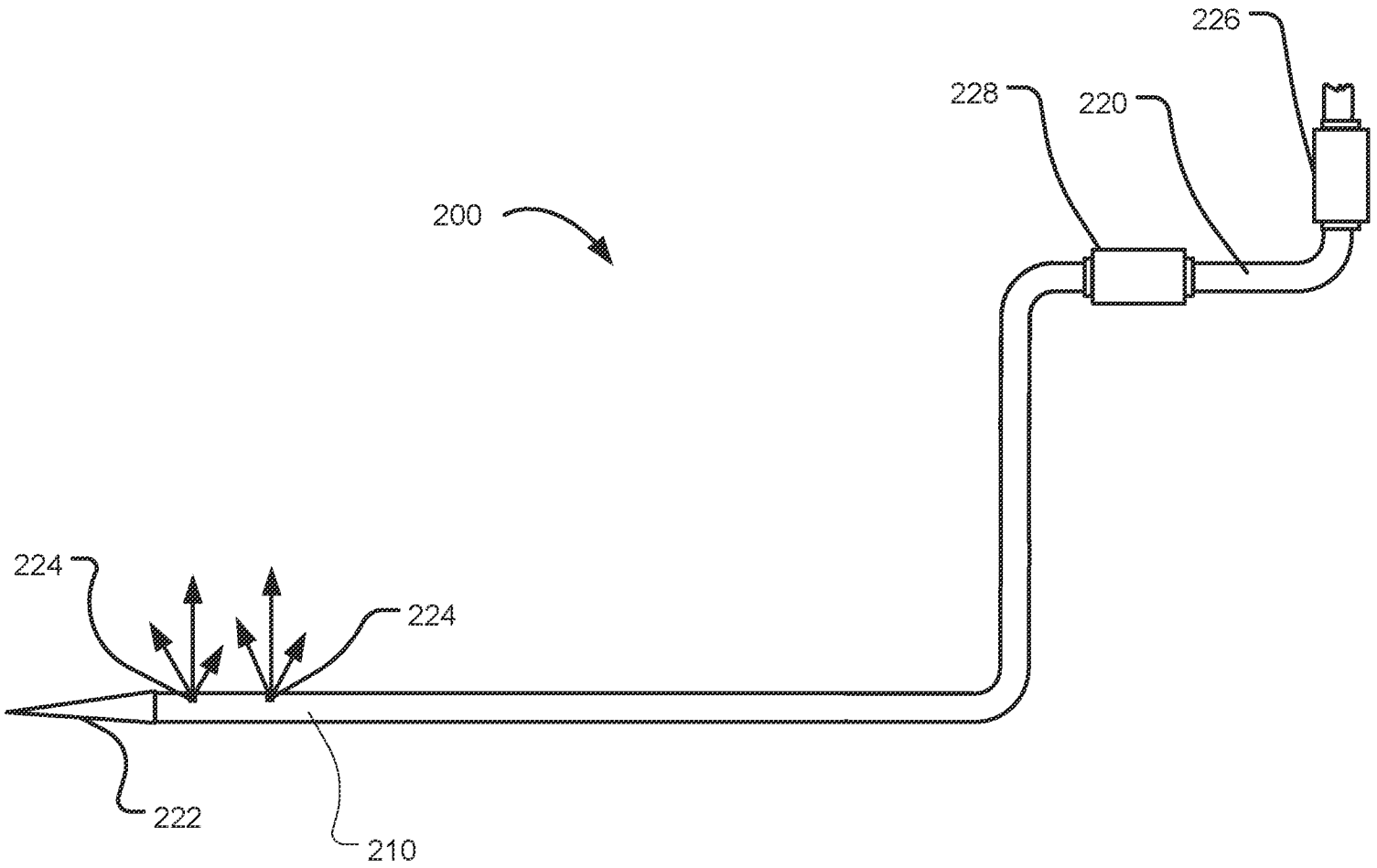
FIG. 4 illustrates a device for removing or eliminating reoccurring spots from spills and removing contaminants and embedded odors, such as pet urine, using a sub-surface fluid injector to flush-clean through the sub-surfaces, cores, and upper surfaces of a surface or flooring, such as a carpet and/or fabrics including carpet backing and padding, upholstery, and mattress, etc., according to at least one embodiment of the disclosure.

As shown in FIGS. 1, 2, and 4 the holes 224 are substantially on an upper surface of sub-surface fluid injector 210 relative to the sub-floor. In this configuration, the holes may spray cleaning fluid directly upward into the padding and toward the carpet and extraction apparatus 300. This "top hole" configuration may directly blast stains, dirt, and contaminants in the padding and carpet and may lead to improved breaking up of dirt, odors, and contaminants in the carpet and padding.

As shown in FIG. 5, holes 224 may be formed in a side of sub-surface fluid injector 210 in order to release fluid sideways into the area between the sub-floor and the padding instead of directly up into the padding and carpet. This may be referred to as a "side hole" configuration where holes are formed in sides of sub-surface fluid injector 210 instead of the top. In the top hole configuration, cleaning fluid is sprayed directly toward extraction apparatus 300. Accordingly, the cleaning fluid is sucked up quickly through the padding, carpet, and into extraction apparatus 300. In contrast, the side hole configuration may provide an advantage that the cleaning fluid is able to be sprayed outward in a direction that is parallel or substantially parallel to the extraction apparatus 300. This allows the cleaning fluid to cover a wider area away from sub-surface fluid injector 210 before being extracted through extraction apparatus 300 so that more surface area of the flooring, carpeting, padding, or fabric may be cleaned.

Figure 6A:
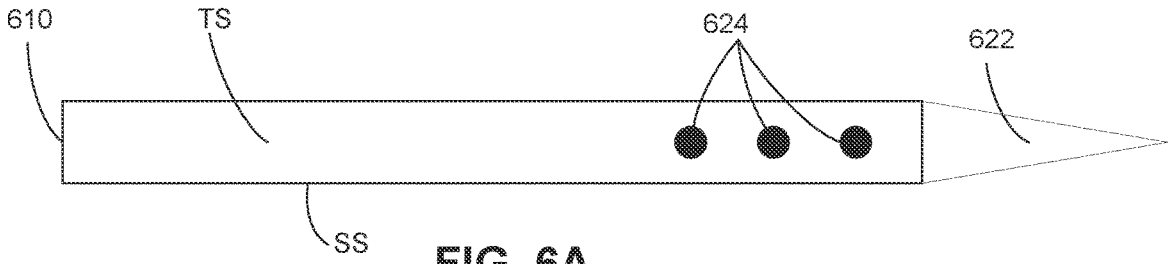
FIG. 6A illustrates a top view of a sub-surface fluid injector device with a top hole configuration according to at least one embodiment of the disclosure.
Figure 6B:
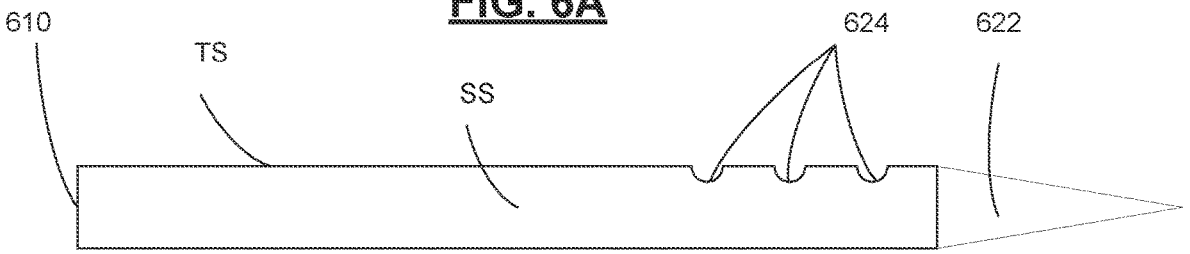
FIG. 6B illustrates a side view of a sub-surface fluid injector device with a top hole configuration according to at least one embodiment of the disclosure.

FIGS. 6A and 6B illustrate the top hole configuration of an embodiment of sub-surface fluid injector 610. FIG. 6A illustrates a top view of sub-surface fluid injector 610 with the top hole configuration, as viewed looking directly down on a top surface TS of sub-surface fluid injector 610. As seen, a plurality of holes 624 are formed in the top surface TS of sub-surface fluid injector 610. FIG. 6B illustrates a side view of sub surface injector 610 with the top hole configuration, as viewed looking directly on a side surface SS of sub-surface fluid injector 610. As seen in both FIGS. 6A and 6B holes 624 are formed in the top surface in a top hole configuration, similar to what is shown in FIG. 1. Accordingly, sub-surface fluid injector 610 is configured to spray cleaning fluid directly up into padding/carpet as described above with respect to FIG. 1.

Figure 7A:
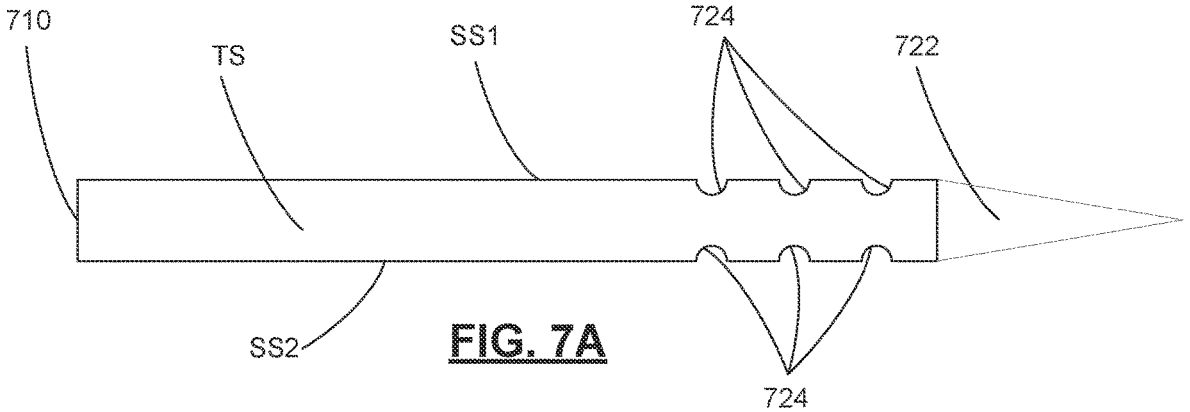
FIG. 7A illustrates a top view of a sub-surface fluid injector device with a side hole configuration according to at least one embodiment of the disclosure.
Figure 7B:
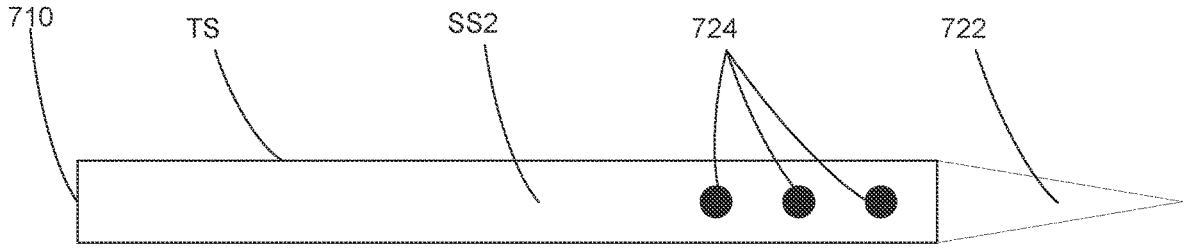
FIG. 7B illustrates a side view of a sub-surface fluid injector device with a side hole configuration according to at least one embodiment of the disclosure.

FIGS. 7A and 7B illustrate the side hole configuration of an embodiment of sub-surface fluid injector 710. FIG. 7A illustrates a top view of sub-surface fluid injector 710 with the side hole configuration, as viewed looking directly down on a top surface TS of sub-surface fluid injector 710. As seen, a plurality of holes 724 are formed in a first side surface SS1 of sub-surface fluid injector 710 and a plurality of holes 724 are formed in a second side surface SS2 of sub-surface fluid injector 710. FIG. 7B illustrates a side view of sub surface injector 710 with the side hole configuration, as viewed looking directly on a first side surface SS1 of sub-surface fluid injector 710. As seen in both FIGS. 7A and 7B holes 724 are formed in the side surfaces SS1 and SS2 in a side hole configuration, similar to what is shown in FIG. 5. Accordingly, sub-surface fluid injector 710 is configured to spray cleaning fluid outward in a direction that is parallel or substantially parallel to the padding/carpet as described above with respect to FIG. 5.

Although FIG. 7A illustrates holes 724 formed in two side surfaces (SS1 and SS2) of sub-surface fluid injector 710, the disclosure is not limited to this configuration. Holes may be formed in one side surface, two side surfaces, or three or more surfaces of a sub-surface fluid injector.

Each of FIGS. 1-7 show various amounts of holes formed in sub-surface fluid injector. However, the disclosure is not so limited. Any number of holes (e.g., one, two, three, four, or more) may be formed in the fluid injector. Fewer holes may have an advantage of more accurate spot cleaning. More holes may have an advantage of cleaning more surface area quicker and more efficiently. Accordingly, the number of holes may be varied according to desires and needs of a user.

Other hole configurations, shapes, and locations are possible and are within the scope of this disclosure. Holes 224 may be disposed anywhere about the surface and circumference of sub-surface fluid injector 210 without limitation. For example, holes may be formed in between the top surface and side surface of a sub-surface fluid injector in a substantially diagonal orientation relative to the sub-floor when the fluid injector is oriented for use. Such a configuration may result in a more direct fluid spray than compared to the side hole configuration, which may be used to break up dirt, odors, and contaminants more directly. Additionally, a substantially diagonal hole configuration also allows for cleaning a wider area than the top hole configuration.

Holes in the sub-surface fluid injector may also be formed in a bottom surface (bottom hole) of the tube. In such a configuration the hole may spray or release cleaning fluid directly against the sub-floor. The fluid may spread on the surface of the sub-floor parallel or substantially parallel to the porous membrane, padding, or carpeting and may then be extracted through the flooring using the extraction device to clean contaminants out of the flooring layers. The bottom hole configuration may allow the cleaning fluid to spread out and allow for a large area of carpeting to be cleaned.

Furthermore, the sub-surface fluid injector may include top holes, side holes, diagonal holes, bottom holes, and/or holes equally spaced around the circumference of the fluid injector, or any combination thereof to obtain proper results according to the desires and needs of a user.

Figure 8A:
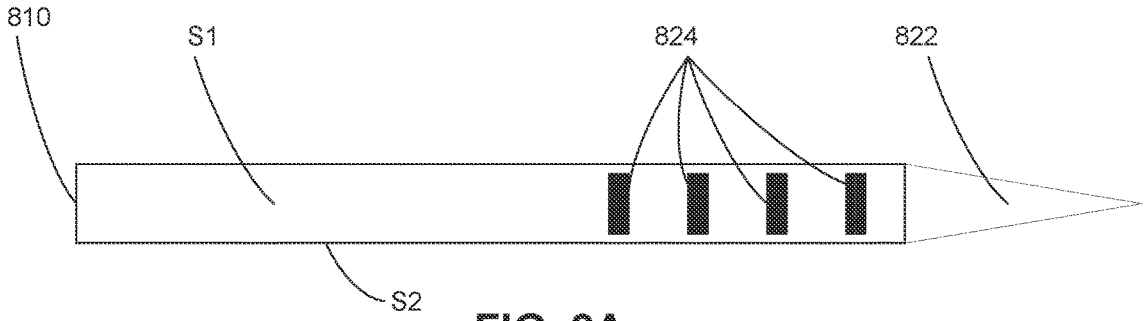
FIG. 8A illustrates plane view of a sub-surface fluid injector device with a hole configuration according to at least one embodiment of the disclosure.
Figure 8B:
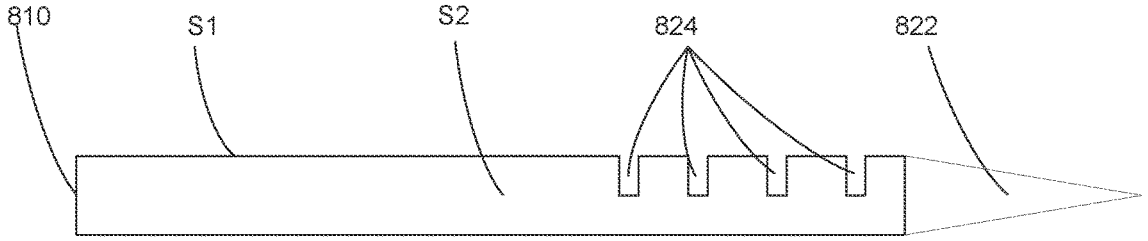
FIG. 8B illustrates plane view of a sub-surface fluid injector device with a hole configuration according to at least one embodiment of the disclosure.
Figure 9:
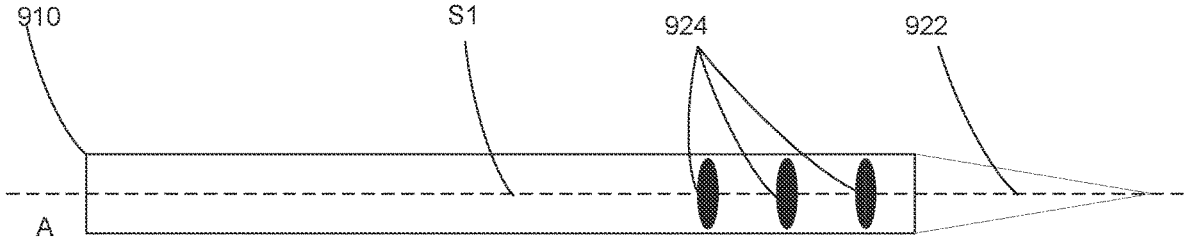
FIG. 9 illustrates plane view of a sub-surface fluid injector device with a hole configuration according to at least one embodiment of the disclosure.

Additionally, the holes shown in FIGS. 1-7B are round holes. However, the disclosure is not limited to round holes. FIG. 8A illustrates a configuration where the holes may be slits 824 formed in a surface of sub-surface fluid injector 810. The surface in which the slits 824 are formed is not particularly limited and may be any surface or side of sub-surface fluid injector 810. Slit-shaped or rectangular-shaped holes as shown in FIG. 8A may allow for a wide fan-shaped spray to be emitted out of sub-surface fluid injector 810, thus resulting in both direct spray to the carpet and lateral spray to clean a wider surface area. As shown the slits 824 are formed in a first surface 51. First surface 51 may be the top surface or side surface of sub-surface fluid injector 810. The slits 824 may be formed in any surface of sub-surface fluid injector 810 to fit the desires and needs of the user.

Additionally, the circular holes may be formed as elongated holes that are elongated relative to circular holes in a direction transverse to an axis A of sub-surface fluid injector 910. Holes 924, similar to slits 824, may also produce a wide fan-shaped spray to be emitted out of sub-surface fluid injector 910, thus resulting in both direct spray to the carpet and lateral spray to facilitate cleaning of a wider surface area. Holes may also be formed elongated along the axis A instead of transverse to axis A. Although it is preferable to elongate the holes transverse to the axis A.

The shapes and orientations of the holes as described herein are not limited but may be any suitable shape, positioning, or orientation for cleaning sub-surfaces or surfaces of flooring, such as a carpet and/or fabrics including upholstery, padding, garments, mattress, and wall coverings, etc. Additionally, any combination of holes/slits described herein may be combined in a same embodiment. For example, elliptical elongated holes may be used in conjunction with circular holes, slits may be used in conjunction with circular holes and/or elongated holes, and the holes may be disposed anywhere along an outer circumference of the sub-surface fluid injector.

A method for removing or eliminating reoccurring spots from spills and embedded odors, such as pet urine, using a cleaning device 200 having a sub-surface fluid injector 210 to flush-clean through the sub-surfaces of the surface or flooring, such as a carpet and/or fabrics including carpet backing and padding, upholstery, and mattress, etc., thoroughly. The method may utilize a vacuum or extraction apparatus 300 and a pointed tube that is bent into a curve or a substantial 90 degree angle or dogleg or a tube that possesses a certain degree of flexibility to thereby facilitate the tube's ability to: 1) penetrate a porous membrane, such as carpeted or other surface or flooring, in order to discharge a fluid into the sub-surface area of the membrane, or the pad and carpet backing under the face fibers of carpeted or other surface or flooring; and 2) to discharge the fluid in a controlled manner over a broad area from the point of original penetration, notwithstanding the inability for the tube to penetrate the membrane or carpet in an area blocked from the surface by an extraction apparatus or other obstacles. These features of cleaning device 200 may allow a source of vacuum or extraction apparatus to simultaneously draw and remove the fluid through a porous membrane, such as carpeted flooring, as the fluid is being discharged in the sub-surface area directly under the extraction apparatus as it is positioned on the surface of the carpet or porous membrane.

Figure 10:
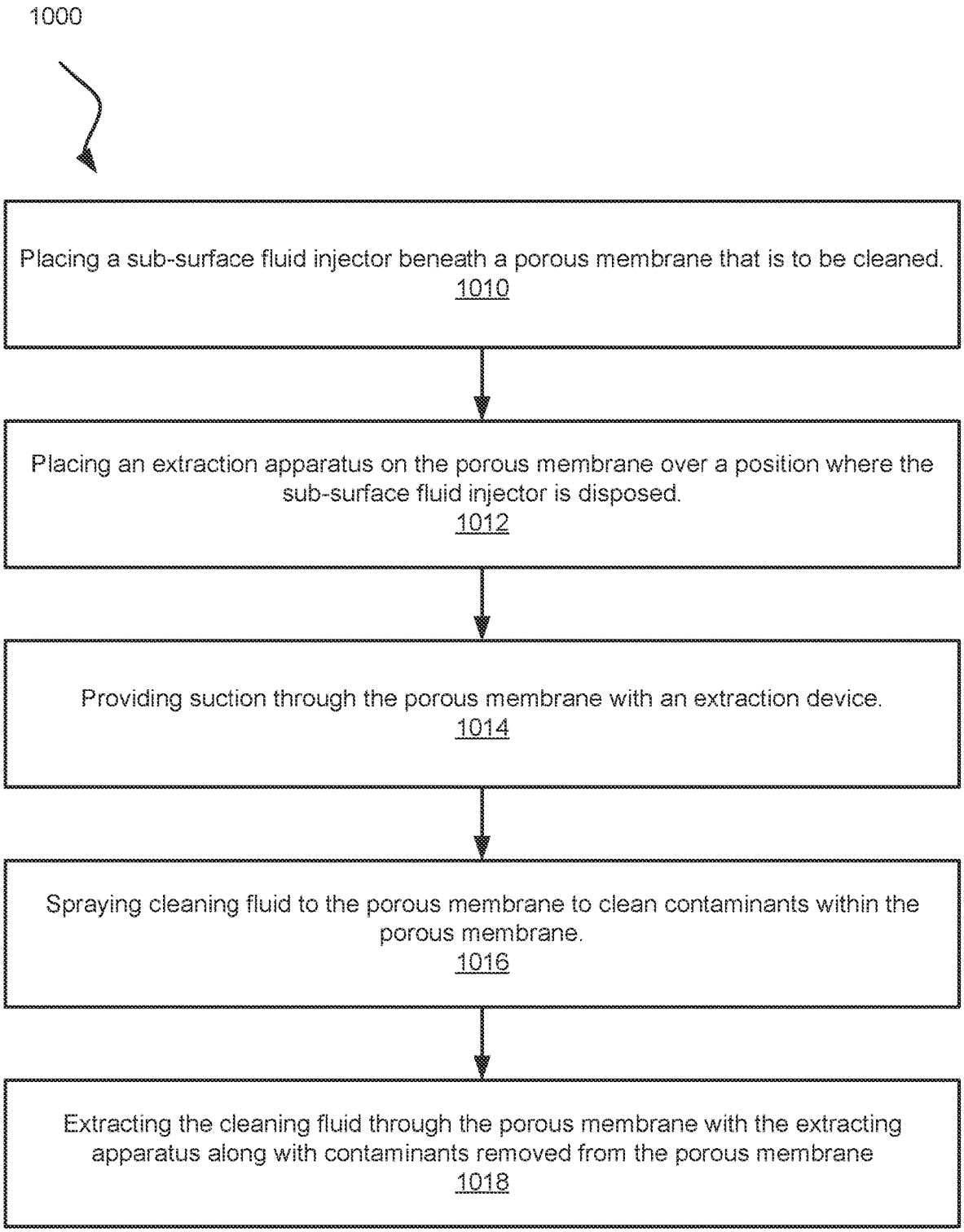
FIG. 10 illustrates an exemplary method according to at least one embodiment of the disclosure.

An exemplary method 1000, according to the disclosure, for cleaning flooring such as carpet is described below and illustrated in FIG. 10. The method may be performed by providing any of the embodiments according to this disclosure and applying them to cleaning flooring using the following steps. As illustrated in FIG. 10, the method 1000 may comprise step 1010 of placing a sub-surface fluid injector beneath a porous membrane that is to be cleaned. The porous membrane may be any sub-surface or flooring, such as a carpeted flooring and/or fabrics including carpet backing and padding, upholstery, and mattress, etc., or any porous membrane that is to be cleaned. The method 1000 may further comprise a step 1012 of placing an extraction apparatus on the porous membrane over a position where the sub-surface fluid injector is disposed. The method 1000 may further comprise a step 1014 of turning on the extraction apparatus to provide suction through the porous membrane. The method may further comprise a step 1016 of actuating sub-surface fluid injector to spray cleaning fluid to the porous membrane to clean contaminants within the porous membrane. The method 1000 may comprise a step 1018 of extracting the cleaning fluid through the porous membrane with the extracting apparatus along with contaminants removed from the porous membrane.

In the foregoing method, either the extraction apparatus may be turned on first, or the sub-surface fluid injector may be turned on first. Either way may be workable for the method. However, in order to ensure that flooding does not occur, it may be advantageous to turn on the extraction apparatus prior to releasing fluid from the sub-surface fluid injector. This will prevent fluid from settling and flowing away from the cleaning area/extraction apparatus before the fluid is extracted. This may advantageously prevent fluid from being in unwanted areas where it may remain and cause rotting of sub-floor, padding, or carpet.

Figure 11:
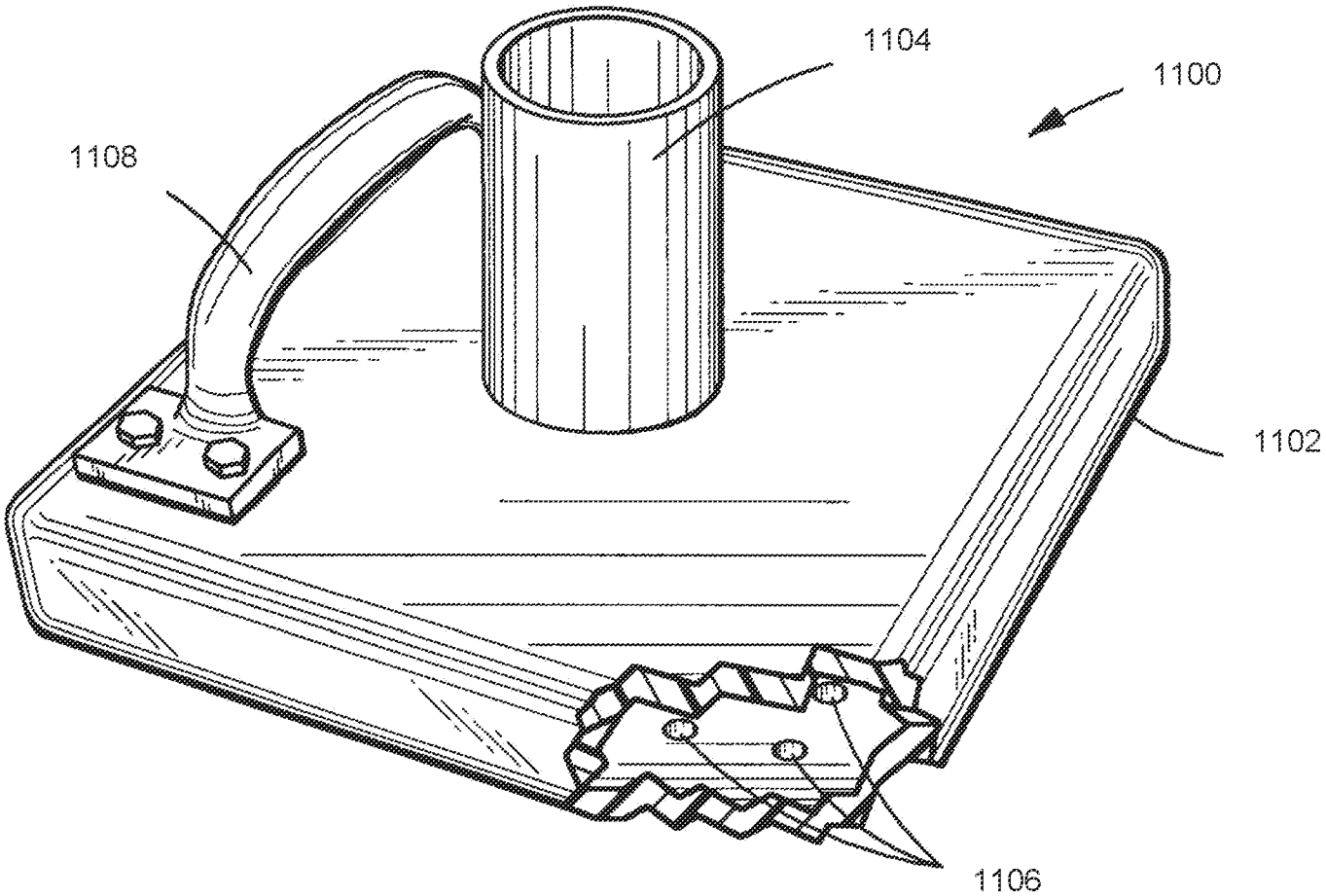
FIG. 11 illustrates a front perspective view of a nozzle or suction head of the disclosure with a portion cut away for clarity according to at least one embodiment of the disclosure.
Figure 12:
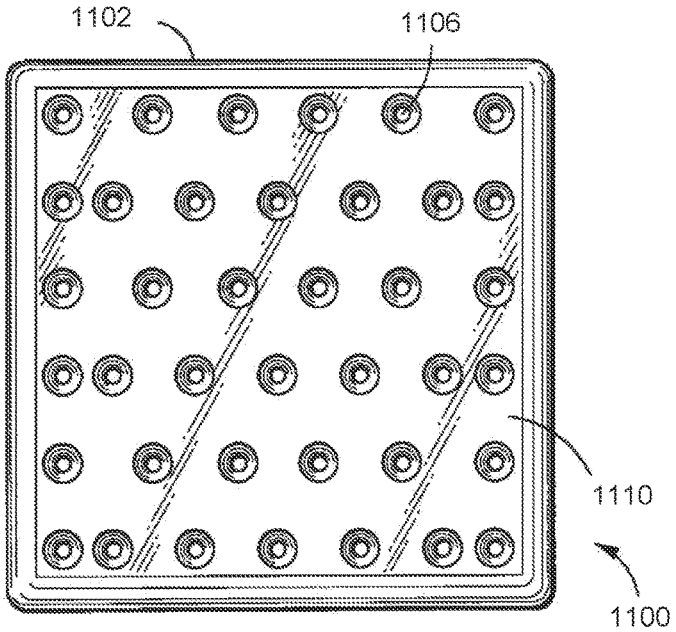
FIG. 12 illustrates a bottom plan view of the nozzle or suction head shown in FIG. 2 according to at least one embodiment of the disclosure.

Referring now to FIGS. 11-14, which illustrate the vacuum or extraction apparatus 300 in greater detail. FIG. 11 illustrates the nozzle or suction head 1100 finding particular but not necessarily exclusive utility for rapidly removing standing water or other cleaning fluids or substances from floors, particularly carpeted floors, following either accidental flooding or purposeful flooding, i.e., water saturation or other fluid saturation, for spot cleaning purposes. As illustrated in FIG. 11, the nozzle 1100 is formed as a hollow, generally rectangular or round body 1102. The shape of body 1102 is not particularly limited and may be any shape suitable for resting on a material providing suction therethrough. Nozzle 1100 may further include a suction tube 1104 that pulls air, fluid, contaminants, and other materials via suction up through a plurality of suction ports 1106 formed in a bottom of nozzle 1100, up through the nozzle body 1102 and to a storage reservoir 302. As shown, nozzle 1100 may further include a handle 1108 FIG. 12 illustrates a bottom view of nozzle 1100. As shown, nozzle 1100 may include a bottom plate 1110 having the plurality of suction ports 1106 provided therein.

Figure 13:
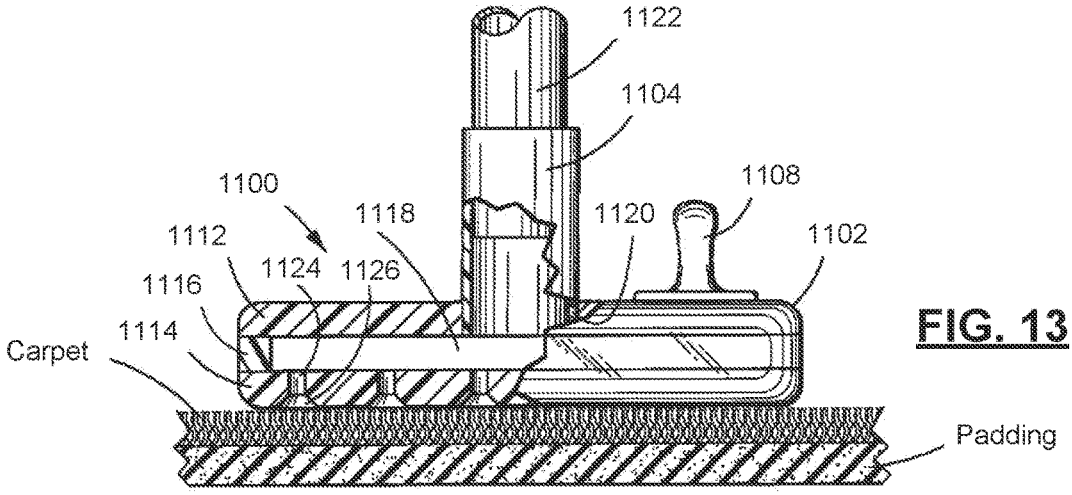
FIG. 13 illustrates a side elevation view of the nozzle or suction head shown in FIG. 2 with a portion cut away for clarity according to at least one embodiment of the disclosure.

FIG. 13 illustrates a side cutaway view of nozzle 1100. As illustrated, nozzle 110 may have an upper plate or wall 1112, a bottom plate or wall 1114, and side walls 1116 defining a shallow, enclosed vacuum or suction manifold or chamber 1118. The bottom plate 1114 defines a plurality of suction ports 1106 opening into the bottom surface 1110 of the nozzle 1100.

Figure 14:
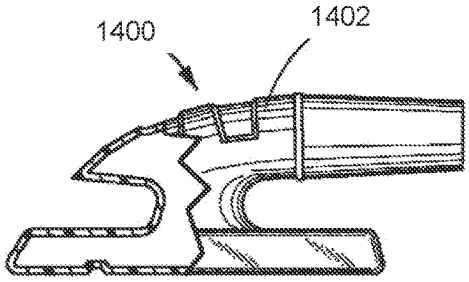
FIG. 14 illustrates a side elevation view of a nozzle or suction head with a portion cut away for clarity according to at least one embodiment of the disclosure.

For applying suction to the suction chamber 1118, a vacuum source connector such as a suction sleeve or tube 1104 opens through a port 1120 in the top plate 1112 and receives an inserted end of a suction wand, tube, hose, or conduit 1122 connected to a vacuum or suction-producing and fluid-collecting apparatus (not shown). As such, the vacuum source connector is in fluid communication with the chamber, thereby enabling a vacuum to be established in the chamber when a vacuum hose is attached to the connector and the vacuum source, i.e., suction producing apparatus, is activated. The suction ports 1106 may be defined by a throat portion 1124 opening into the chamber 1118, and a tapered or cylindrical counterbore 1126 opening into the outer surface 1102 of the base plate 1114. It should be appreciated that any shape of nozzle and/or suction ports may be used, and the disclosure is not necessarily limited by the figures. For example, FIG. 14 illustrates an alternate shape of nozzle 1400 including a handle/suction tube 1402.

Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments but should be defined only in accordance with the following claims and their equivalents. The foregoing description has been presented for the purposes of illustration and description. It is not intended to be exhaustive or to limit the disclosure to the precise form disclosed. Many modifications and variations are possible in light of the above teaching. Further, it should be noted that any or all of the aforementioned alternate implementations may be used in any combination desired to form additional hybrid implementations of the disclosure.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

Examples

The following examples pertain to further embodiments.

Example 1 is a cleaning device for cleaning a porous membrane. The cleaning device includes a sub-surface fluid injector comprising a tube in fluid communication with a fluid reservoir containing a cleaning fluid, a tip disposed at the end of the tube for inserting the sub-surface fluid injector beneath the porous membrane, a hole formed in a surface of the tube, and a pulsating fluid valve that pulsates cleaning fluid through the tube. The tube is placed beneath the porous membrane. The pulsating fluid valve causes cleaning fluid to flow through the tube and out of the hole to clean contaminants from the porous membrane.

Example 2 is the cleaning device according to Example 1, wherein the cleaning fluid is pulsated at a harmonic frequency or resonant frequency to facilitate physical agitation of contaminants in the porous membrane.

Example 3 is the cleaning device according to Examples 1 or 2, wherein the tube may be bent at an angle to allow a first portion of the sub-surface fluid injector to be disposed beneath the porous membrane and a second portion of the sub-surface fluid injector to extend above the porous membrane.

Example 4 is the cleaning device according to any of Examples 1-3, wherein the tube is one of either a flexible tube or a rigid tube. The tip is one of either a flexible tip or a rigid tip.

Example 5 is the cleaning device according to any of Examples 1-4, wherein the hole is formed in top surface of the tube at a position to spray cleaning fluid upward into the porous membrane.

Example 6 is the cleaning device according to any of Examples 1-5, wherein the hole is formed in a side surface of the tube at a position to spray cleaning fluid in a direction that is parallel or substantially parallel to the porous membrane.

Example 7 is the cleaning device according to any of Examples 1-6, wherein the hole has a circular shape.

Example 8 is the cleaning device according to any of Examples 1-7, wherein the hole has an elongated shape. The shape of the hole is elongated in a direction perpendicular to a longitudinal axis of the tube.

Example 9 is the cleaning device according to any of Examples 1-8, wherein the hole is a slit formed in the tube in a direction perpendicular to a longitudinal axis of the tube. The slit provides a fan-shaped spray of cleaning fluid out of the tube into the porous membrane.

Example 10 is the cleaning device according to any of Examples 1-9, wherein the sub-surface fluid injector comprises a plurality of holes formed in the surface of the tube. The plurality of holes comprises one or more of: a hole formed in top surface of the tube at a position to spray cleaning fluid upward into the porous membrane; a hole formed in a side surface of the tube at a position to spray cleaning fluid in a direction that is parallel or substantially parallel to the porous membrane; a hole having a circular shape; a hole having an elongated shape that is elongated in a direction perpendicular to a longitudinal axis of the tube; and a hole that is a slit formed in the tube in a direction perpendicular to a longitudinal axis of the tube wherein the slit provides a fan-shaped spray of cleaning fluid out of the tube.

Example 11 is a cleaning system for cleaning a porous membrane. The cleaning system includes an extraction device that provides suction to the porous membrane, and a sub-surface fluid injector. The sub-surface fluid injector includes a tube in fluid communication with a fluid reservoir containing a cleaning fluid, a tip disposed at the end of the tube for inserting the sub-surface fluid injector beneath the porous membrane, a hole formed in a surface of the tube, and a pulsating fluid valve that pulsates cleaning fluid through the tube. The sub-surface fluid injector is disposed beneath the porous membrane. The extraction device is disposed on an upper surface of the porous membrane. The pulsating fluid valve causes cleaning fluid to flow through the tube and out of the hole to the porous membrane. The extraction device extracts the cleaning fluid through the porous membrane.

Example 12 is the cleaning system according to Example 11, wherein the cleaning fluid is pulsated at a harmonic frequency or resonant frequency to facilitate physical agitation of contaminants in the porous membrane.

Example 13 is the cleaning system according to Examples 11 or 12, wherein the tube may be bent at an angle to allow a first portion of the sub-surface fluid injector to be disposed beneath the porous membrane and a second portion of the sub-surface fluid injector to extend above the porous membrane.

Example 14 is the cleaning system according to any of Examples 11-13, wherein the tube is one of either a flexible tube or a rigid tube. The tip is one of either a flexible tip or a rigid tip.

Example 15 is the cleaning system according to any of Examples 11-14, wherein the sub-surface fluid injector comprises a plurality of holes formed in the surface of the tube. The plurality of holes comprises one or more of: a hole formed in top surface of the tube at a position to spray cleaning fluid upward into the porous membrane; a hole formed in a side surface of the tube at a position to spray cleaning fluid in a direction that is parallel or substantially parallel to the porous membrane; a hole having a circular shape; a hole having an elongated shape that is elongated in a direction perpendicular to a longitudinal axis of the tube; and a hole that is a slit formed in the tube in a direction perpendicular to a longitudinal axis of the tube wherein the slit provides a fan-shaped spray of cleaning fluid out of the tube.

Example 16 is a cleaning method for cleaning a porous membrane using a cleaning system including an extraction device that provides suction to the porous membrane and a sub-surface fluid injector including a tube in fluid communication with a fluid reservoir containing a cleaning fluid, a tip disposed at the end of the tube for inserting the sub-surface fluid injector beneath the porous membrane, a hole formed in a surface of the tube, and a pulsating fluid valve that pulsates cleaning fluid through the tube. the method includes placing the sub-surface fluid injector beneath the porous membrane, placing the extraction apparatus on the porous membrane over the sub-surface fluid injector, providing suction through the porous membrane with the extraction device, pulsating cleaning fluid out of the hole to the porous membrane, and extracting the cleaning fluid through the porous membrane with the extracting apparatus.

Example 17 is the cleaning method according to Example 16, wherein the cleaning fluid is pulsated at a harmonic frequency or resonant frequency to facilitate physical agitation of contaminants in the porous membrane.

Example 18 is the cleaning method according to Examples 16 or 17, wherein the tube may be bent at an angle to allow a first portion of the sub-surface fluid injector to be disposed beneath the porous membrane and a second portion of the sub-surface fluid injector to extend above the porous membrane.

Example 19 is the cleaning method according to any of Examples 16-18, wherein the tube is one of either a flexible tube or a rigid tube. The tip is one of either a flexible tip or a rigid tip.

Example 20 is the cleaning method according to any of Examples 16-19, wherein the sub-surface fluid injector comprises a plurality of holes formed in the surface of the tube. The plurality of holes comprises one or more of: a hole formed in top surface of the tube at a position to spray cleaning fluid upward into the porous membrane; a hole formed in a side surface of the tube at a position to spray cleaning fluid in a direction that is parallel or substantially parallel to the porous membrane; a hole having a circular shape; a hole having an elongated shape that is elongated in a direction perpendicular to a longitudinal axis of the tube; and a hole that is a slit formed in the tube in a direction perpendicular to a longitudinal axis of the tube wherein the slit provides a fan-shaped spray of cleaning fluid out of the tube.

It will be appreciated that various features disclosed herein provide significant advantages and advancements in the art. The following claims are exemplary of some of those features.

In the foregoing Detailed Description of the Disclosure, various features of the disclosure are grouped together in a single embodiment for the purpose of streamlining the disclosure. This method of disclosure is not to be interpreted as reflecting an intention that the claimed disclosure requires more features than are expressly recited in each claim. Rather, inventive aspects lie in less than all features of a single foregoing disclosed embodiment.

It is to be understood that any features of the above-described arrangements, examples, and embodiments may be combined in a single embodiment comprising a combination of features taken from any of the disclosed arrangements, examples, and embodiments.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements.

Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The foregoing description has been presented for the purposes of illustration and description. It is not intended to be exhaustive or to limit the disclosure to the precise form disclosed. Many modifications and variations are possible in light of the above teaching. Further, it should be noted that any or all the aforementioned alternate implementations may be used in any combination desired to form additional hybrid implementations of the disclosure.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

What is claimed is:

1. A cleaning device for cleaning a porous membrane that comprises a first layer comprising carpet fibers, a second layer comprising a carpet backing, and a third layer comprising a padding, wherein the cleaning device comprises:

an extraction device comprising a nozzle, wherein the nozzle comprises a substantially flat bottom surface configured to be disposed on top of the porous membrane, and wherein the extraction device provides suction to the porous membrane; and a sub-surface fluid injector comprising:

a tube in fluid communication with a fluid reservoir containing a cleaning fluid;

a tip disposed at an end of the tube for inserting the sub-surface fluid injector beneath the porous membrane;

a hole formed in a surface of the tube; and a pulsating fluid valve that pulsates the cleaning fluid through the tube such that the cleaning fluid flows through the tube and out of the hole;

wherein at least a portion of the tube is configured to be placed beneath each of the first layer, the second layer, and the third layer of the porous membrane;

wherein the pulsating fluid valve when actuated causes the cleaning fluid to flow through the tube and out of the hole such that the cleaning fluid physically agitates the porous membrane when the cleaning fluid is discharged from the tube under pressure;

wherein the tip of the sub-surface fluid injector is configured to be disposed underneath the nozzle of the extraction device such that the extraction device provides the suction to extract the cleaning fluid through each of the first layer, the second layer, and the third layer of the porous membrane.

2. The cleaning device according to claim 1, wherein the cleaning fluid is pulsated at a harmonic frequency or resonant frequency to cause the cleaning fluid to physically agitate contaminants in the porous membrane.

3. The cleaning device according to claim 1, wherein the tube comprises a bend enabling a first portion of the sub-surface fluid injector to be disposed beneath the first layer, the second layer, and the third layer of the porous membrane, and a second portion of the sub-surface fluid injector to extend above the porous membrane.

4. The cleaning device according to claim 1, wherein the tube is one of either:

a flexible tube; or a rigid tube; and wherein the tip is one of either:

a flexible tip; or a rigid tip.

5. The cleaning device according to claim 1, wherein the hole is formed in a top surface of the tube at a position to spray the cleaning fluid upward into the porous membrane such that the cleaning fluid is first pulsated into the third layer of the porous membrane.

6. The cleaning device according to claim 1, wherein the hole is formed in a side surface of the tube at a position to spray the cleaning fluid in a direction substantially parallel to the porous membrane.

7. The cleaning device according to claim 1, wherein each of the first layer, the second layer, and the third layer of the porous membrane is disposed on top of a subfloor such that the third layer is located adjacent to the subfloor; and wherein the hole is formed in a bottom surface of the tube at a position to spray the cleaning fluid downward against the subfloor to thereby spread the cleaning fluid substantially parallel to the porous membrane.

8. The cleaning device according to claim 1, wherein the hole has a circular shape.

9. The cleaning device according to claim 1, wherein the hole has an elongated shape that is one or more of:

elongated in a direction perpendicular or parallel to a longitudinal axis of the tube; or a slit formed in the tube in a direction perpendicular to the longitudinal axis of the tube, wherein the slit provides a fan-shaped spray of the cleaning fluid out of the tube.

10. The cleaning device according to claim 1, wherein the sub-surface fluid injector comprises a plurality of holes formed in the surface of the tube;

wherein the plurality of holes comprises one or more of:

a hole formed in a top surface of the tube at a position to spray the cleaning fluid upward into the porous membrane;

a hole formed in a side surface of the tube at a position to spray the cleaning fluid in a direction that is substantially parallel to the porous membrane;

a hole formed in a bottom surface of the tube at a position to spray the cleaning fluid downward against a subfloor to spread the cleaning fluid substantially parallel to the porous membrane;

a hole having a circular shape;

a hole having an elongated shape that is elongated in a direction perpendicular or parallel to a longitudinal axis of the tube; and the hole that is a slit formed in the tube in a direction perpendicular or parallel to the longitudinal axis of the tube wherein the slit provides a fan-shaped spray of the cleaning fluid out of the tube.

11. A cleaning system for cleaning a porous membrane that comprises a first layer comprising carpet fibers, a second layer comprising a carpet backing, and a third layer comprising a padding, wherein the cleaning system comprises:

an extraction device that provides suction to the porous membrane, wherein the extraction device comprises a nozzle having a substantially flat bottom surface configured to be disposed on top of the porous membrane; and a sub-surface fluid injector comprising:

a tube in fluid communication with a fluid reservoir containing a cleaning fluid;

a tip disposed at an end of the tube for inserting the sub-surface fluid injector beneath the porous membrane;

a hole formed in a surface of the tube; and a pulsating fluid valve that pulsates the cleaning fluid through the tube such that the cleaning fluid flows through the tube and out of the hole;

wherein at least a portion of the sub-surface fluid injector is configured to be disposed beneath each of the first layer, the second layer, and the third layer of the porous membrane;

wherein the extraction device is disposed on an upper surface of the porous membrane and is used in conjunction with the sub-surface fluid injector;

wherein the pulsating fluid valve when actuated causes the cleaning fluid to flow through the tube and out of the hole such that the cleaning fluid physically agitates the porous membrane when the cleaning fluid is discharged from the tube under pressure;

wherein the extraction device extracts the cleaning fluid through one or more of the first layer, the second layer, or the third layer of the porous membrane;

wherein the extraction device and the pulsating fluid valve operate simultaneously such that the extraction device provides the suction simultaneously with the pulsating fluid valve pulsating the cleaning fluid; and wherein the tip of the sub-surface fluid injector is configured to be disposed underneath the nozzle of the extraction device such that the extraction device provides the suction to extract the cleaning fluid through each of the first layer, the second layer, and the third layer of the porous membrane.

12. The cleaning system according to claim 11, wherein the cleaning fluid is pulsated at a harmonic frequency or resonant frequency to cause the cleaning fluid to physically agitate contaminants in the porous membrane.

13. The cleaning system according to claim 11, wherein the tube comprises a bend enabling a first portion of the sub-surface fluid injector to be disposed beneath each of the first layer, the second layer, and the third layer of the porous membrane, and a second portion of the sub-surface fluid injector to extend above the porous membrane.

14. The cleaning system according to claim 11, wherein the tube is one of either:

a flexible tube; or a rigid tube; and wherein the tip is one of either:

a flexible tip; or a rigid tip.

15. The cleaning system according to claim 11, wherein the sub-surface fluid injector comprises a plurality of holes formed in the surface of the tube;

wherein the plurality of holes comprises one or more of:

a hole formed in a top surface of the tube at a position to spray the cleaning fluid upward into the porous membrane;

a hole formed in a side surface of the tube at a position to spray the cleaning fluid in a direction that is substantially parallel to the porous membrane;

a hole formed in a bottom surface of the tube at a position to spray the cleaning fluid downward against a subfloor to spread the cleaning fluid substantially parallel to the porous membrane;

a hole having a circular shape;

a hole having an elongated shape that is elongated in a direction perpendicular or parallel to a longitudinal axis of the tube; and the hole that is a slit formed in the tube in a direction perpendicular or parallel to the longitudinal axis of the tube wherein the slit provides a fan-shaped spray of cleaning fluid out of the tube.

* * * * *